US010477334B2

(12) United States Patent
Aniya

(10) Patent No.: US 10,477,334 B2
(45) Date of Patent: Nov. 12, 2019

(54) METHOD AND APPARATUS FOR EVALUATING AUDIO DEVICE, AUDIO DEVICE AND SPEAKER DEVICE

(71) Applicant: Setuo Aniya, Hidaka (JP)

(72) Inventor: Setuo Aniya, Hidaka (JP)

( * ) Notice: Subject to any disclaimer, the term of this patent is extended or adjusted under 35 U.S.C. 154(b) by 0 days.

(21) Appl. No.: 15/541,690

(22) PCT Filed: Jan. 7, 2016

(86) PCT No.: PCT/JP2016/050359
§ 371 (c)(1),
(2) Date: Jul. 5, 2017

(87) PCT Pub. No.: WO2016/111330
PCT Pub. Date: Jul. 14, 2016

(65) Prior Publication Data

US 2018/0027348 A1 Jan. 25, 2018

(30) Foreign Application Priority Data

Jan. 9, 2015 (JP) ..... 2015-003114
Feb. 16, 2015 (JP) ..... 2015-027206

(51) Int. Cl.
*H04R 29/00* (2006.01)
*H04R 1/02* (2006.01)
(Continued)

(52) U.S. Cl.
CPC ..... *H04R 29/002* (2013.01); *G10K 15/00* (2013.01); *G10L 25/51* (2013.01); *H04R 1/02* (2013.01);
(Continued)

(58) Field of Classification Search
None
See application file for complete search history.

(56) References Cited

U.S. PATENT DOCUMENTS 6,296,489 B1 * 10/2001 Blass ..... G09B 19/04 434/185
6,477,255 B1 11/2002 Yoshida et al.
(Continued)

FOREIGN PATENT DOCUMENTS

JP H05-276591 A 10/1993
JP H08-079879 A 3/1996
(Continued)

OTHER PUBLICATIONS

Mar. 29, 2016 International Search Report issued in International Patent Application No. PCT/JP2016/050359.
(Continued)

*Primary Examiner* — Qin Zhu
(74) *Attorney, Agent, or Firm* — Oliff PLC

(57) ABSTRACT

A method and apparatus for evaluating audio device for evaluating performance of an audio device by inputting into the audio device an audio signal having a waveform in which a plurality of waves with different frequency components are superimposed, comparing the sound waveform before the input and the sound waveform after the input, and finding the degree of conformity therebetween. An audio device is characterized in that, with sound field correction as a precondition, low-pitch ranges can be reproduced by using numerous small-diameter speakers, a single one of which is insufficient to reproduce low-pitch ranges despite good group delay characteristic, and outstanding waveform reproducibility can be achieved by covering the periphery of the speakers with sound-absorbent material so as to remove noise emitted by surfaces other than the front surface of cone paper.

2 Claims, 8 Drawing Sheets

(51) Int. Cl.

| | |
|---|---|
| ***H04R 1/24*** | (2006.01) |
| ***H04R 1/28*** | (2006.01) |
| ***H04R 3/04*** | (2006.01) |
| ***H04R 3/14*** | (2006.01) |
| ***H04R 3/00*** | (2006.01) |
| ***H04R 1/26*** | (2006.01) |
| ***G10L 25/51*** | (2013.01) |
| ***G10K 15/00*** | (2006.01) |

(52) U.S. Cl.

CPC ..... *H04R 1/025* (2013.01); *H04R 1/24* (2013.01); *H04R 1/288* (2013.01); *H04R 3/00* (2013.01); *H04R 3/04* (2013.01); *H04R 3/14* (2013.01); *H04R 29/00* (2013.01); *H04R 29/001* (2013.01); *H04R 1/26* (2013.01); *H04R 2201/028* (2013.01)

(56) References Cited

U.S. PATENT DOCUMENTS

| | | | | |
|---|---|---|---|---|
| 7,664,231 | B2 * | 2/2010 | Schmidmer | H04M 3/2236 370/241 |
| 8,150,683 | B2 * | 4/2012 | Padhi | G10L 15/10 704/216 |
| 8,985,268 | B2 | 3/2015 | Wilson | |
| 9,286,808 | B1 * | 3/2016 | Raley | G09B 15/003 |
| 2005/0013444 | A1 * | 1/2005 | Dorfman | H04R 29/001 381/58 |
| 2005/0207582 | A1 * | 9/2005 | Asada | G10H 1/26 381/56 |
| 2005/0271230 | A1 | 12/2005 | Sasaki | |
| 2006/0072776 | A1 | 4/2006 | Vishwamitra | |
| 2007/0201711 | A1 | 8/2007 | Meyer et al. | |
| 2008/0036865 | A1 * | 2/2008 | Liu | H04N 17/00 348/180 |
| 2008/0304672 | A1 * | 12/2008 | Yoshizawa | G08G 1/017 381/56 |
| 2009/0190766 | A1 * | 7/2009 | Klayman | H04S 3/002 381/18 |
| 2009/0238371 | A1 * | 9/2009 | Rumsey | H04R 29/001 381/58 |
| 2011/0013779 | A1 * | 1/2011 | Arthur | H04R 29/00 381/56 |
| 2011/0211705 | A1 | 9/2011 | Hutt | |
| 2012/0155660 | A1 * | 6/2012 | Xiong | G10L 25/69 381/58 |
| 2013/0236031 | A1 | 9/2013 | Risberg | |
| 2013/0336491 | A1 * | 12/2013 | Hara | H04R 29/00 381/56 |
| 2014/0270209 | A1 * | 9/2014 | Mihelich | H04R 29/001 381/59 |
| 2014/0353075 | A1 | 12/2014 | Wilson | |
| 2016/0127831 | A1 | 5/2016 | Merz | |
| 2016/0183020 | A1 * | 6/2016 | Gatien | H04R 29/00 381/56 |

FOREIGN PATENT DOCUMENTS

| | | | |
|---|---|---|---|
| JP | H11-103495 | A | 4/1999 |
| JP | 2004-193811 | A | 7/2004 |
| JP | 2007-158636 | A | 6/2007 |
| JP | 2013-255049 | A | 12/2013 |

OTHER PUBLICATIONS

Jul. 11, 2017 English Language International Preliminary Report on Patentability issued in Patent Application No. PCT/JP2016/050359.

Potirakis, S. M. et al. "Time-Domain Nonlinear Modeling of Practical Electroacoustic Transducers," Journal of Audio Engineering Society, Audio Engineering Society, New York, NY, US, vol. 47, No. 6, Jun. 1, 1999, pp. 447-467.

Aug. 10, 2018 Partial Supplementary European Search Report Issued in European Patent Application No. 16735069.3.

Feb. 13, 2019 Office Action issued in U.S. Appl. No. 15/971,037.

* cited by examiner

7 = PREAMPLIFIER WITH SOUND FILED CORRECTION FUNCTION

METHOD AND APPARATUS FOR EVALUATING AUDIO DEVICE, AUDIO DEVICE AND SPEAKER DEVICE

BACKGROUND

Technical Field

The present invention relates to a method and an apparatus for evaluating an audio device which enables to evaluate a performance of an audio device more objectively, and audio device which enables to reproduce a sound more faithfully from a waveform of a audio signal of a source, having the waveform including complicated harmonics such as a sound of string instruments.

Description of the Related Art

For example, to objectively evaluate a performance of an audio device composed of amplifier and speaker, the performance is considered to be determined based on an evaluation criteria such as sending an audio signal recorded on a source (recording medium of sound) to a speaker, receiving a sound emitted from the speaker using the microphone and observing the sound waveform by an oscilloscope or the like to find out a degree of conformity between the sound waveform and the sound waveform recorded on the original source. This is because it is logically impossible that different sounds are emitted in spite of a conformity between sound waveforms. Therefore, it is considered to be the most rational way to evaluate a performance of a reproduction device by a degree of conformity between sound waveforms. It is considered that an evaluation for various audio devices used in audio signal transmission path such as an audio amplifier and various cords and the like should be evaluated based on the degree of conformity between the sound waveform before the input and the sound waveform after the output in/from these systems to be measured.

However, these objective performance evaluations have not been tested at all in the past. According to audio magazines, etc., it is a generally known method that a deformation of the waveform after passing through the amplifier is simply observed by an oscilloscope using a signal of simple repetition waveform of single frequency such as a sine wave, a rectangular wave and the like obtained from a transmitter and the like. Also, physical properties of the audio device such as distortion ratio, S/N ratio, damping factor of a speaker, transient characteristic and frequency characteristic or dynamic range and etc. are focused and quality of them are evaluated based on the idea that better sound should show better quality of these properties. Little is known about a performance evaluation method for other audio device used for audio signal transmission paths such as audio cables.

Further, an audio device having one speaker which is a so-called single cone type speaker and an audio device having a multi-way type speaker in which a low frequency range, an intermediate frequency range, and a high frequency range are handled by different speakers respectively, are known as traditional audio device which creates a sound from an audio signal recorded on a source (recording medium) by using mainly amplifier and speaker. Among audio device having such a multi-way type speaker, the audio device using a so-called L.C.R network for dividing a frequency range handled by each speaker, and the audio device using multiple amplifier type and etc. having analog or digital channel divider and several amplifiers are known as well. Further, to improve reproduction characteristic, sound field correction device and the like is sometimes used for the audio device (see patent document 1).

PRIOR ART DOCUMENT

Patent Document

Patent document 1: Japanese Patent Laid Open Publication No. 1996-79879

SUMMARY OF THE INVENTION

However, for example even if a deformation state of a sine wave or a rectangular wave, etc., is observed, it is completely uncertain in traditional evaluation method whether there is a relation between such a deformation state and the quality of a sound. In some cases, an amplifier having a larger deformation degree is often evaluated to emit a better sound than an amplifier having a smaller deformation degree. In the same way as described above, the evaluation of sound quality is bad even when physical properties such as distortion ratio, S/N ratio, damping factor of speaker, transient characteristic and etc. are excellent. Conversely, the sound quality of amplifiers such as a vacuum tube amplifier with bad physical properties is highly evaluated in many cases. As a result, a relationship between these physical properties and sound quality remain unknown.

Thus, in a traditional way, there are no methods for evaluating a performance of the audio device objectively other than an evaluation subjectively by hearing.

There is no method other than subjectively evaluating the sound by making full use of word expressions such as pleasant sound by hearing feeling, refreshing sound, beautiful sound, clear sound, powerful sound, sharp sound, hard sound, soft sound, warm sound, cold sound, relieving sound, sound with strong damping effect, quick responding sound, sound with large dynamic range or etc. Also, in the traditional audio device, original naturalness of sound such as a sound of string instruments or etc. is mostly lost when a audio signal of source having a waveform including particularly complicated harmonics such as the sound of string instruments, is converted to a sound through the speaker device.

The present invention is provided to solve abovementioned problems. An object of the present invention is to provide a method and an apparatus for evaluating an audio device capable of evaluating a performance of an audio device more objectively, and audio device capable of reproducing a natural sound by faithfully reproducing a waveform of a audio signal of a source having a waveform including complicated harmonics such as the sound of string instruments.

Problem to be Solved by the Invention

In order to solve abovementioned problems, following means are provided.

(1) A method for evaluating an audio device, including:

inputting into an audio device an audio signal having a waveform in which a plurality of waves with different frequency components are superimposed, comparing a sound waveform before input and the sound waveform after output, and evaluating a performance of the audio device based on a degree of conformity of the two waveforms.

(2) A device for evaluating an audio device, including:

a measuring audio signal output device that delivers an audio signal to be measured having a waveform in which a plurality of waves with different frequency components are superimposed; and a waveform comparison device that compares a waveform of a signal output from an audio device when the audio signal to be measured is output from the measuring audio signal output device and is input to the audio device which is an evaluation target, and a waveform of the audio signal to be measured input into the audio device, and obtains a degree of conformity of the two waveforms.

(3) A speaker device including;

a plurality of small-diameter single speaker units in which the single speaker unit alone is insufficient to reproduce a low frequency range; and a sound-absorbent member which covers a part other than a surface facing a hearing direction of a vibrator which emit a sound of the single speaker unit for preventing emission of noise and emitting only a signal sound, when a sound emitted from the surface of the vibrator of the single speaker unit, is called the signal sound and a sound other than the signal sound including a sound emitted from a back surface of the vibrator and a sound generated from an object which is in contact with the single speaker unit and vibrated accompanied by a vibration of the vibrator, is called a noise.

(4) A multi-way type speaker device:

wherein a reproduction frequency range is divided into a plurality of frequency ranges and each frequency range is reproduced by each separate assigning speaker, and comprising:

an assigning speaker that reproduces a low frequency range among a plurality of assigning speakers constituting the multi-way type speaker and obtained by setting a single speaker having a small-diameter and ability insufficient to reproduce the low frequency as a single speaker unit and combining a plurality of single speaker unit, and a sound-absorbent member which covers a part other than a surface facing the hearing direction of a vibrator which emit a sound of the unit speaker for preventing emission of noise and emitting only a signal sound, when a sound emitted from the surface of the vibrator of the unit speaker, is called the signal sound and a sound other than the signal sound including a sound emitted from a back surface of the vibrator and a sound generated from an object which is in contact with the single speaker unit and vibrated accompanied by a vibration of the vibrator, is called a noise.

(5) An audio device comprising:

an amplification device part which an audio signal from a sound source is input into and performs required processing and amplification of the audio signal; and a speaker device which is connected to the amplification device part and the processed and amplified audio signal is input into and emits this audio signal;

wherein the amplification device part includes a correction device which corrects at least one of a group delay characteristic, a frequency characteristic of the audio device or an acoustic characteristic of a room in which the audio device is installed; and the speaker device of claim 3 or 4 is used as a speaker device.

(6) An audio device comprising:

an amplification device part which an audio signal from a sound source is input into and performs required processing and amplification of the audio signal; and a speaker device which is connected to the amplification device part and inputs the processed and amplified audio signal and outputs this audio signal;

wherein the amplification device part includes a correction device which corrects at least one of a group delay characteristic, a frequency characteristic of the speaker device or an acoustic characteristic of a room in which the audio device is installed;

a channel divider device that divides the audio signal into a plurality of frequency ranges and outputs the audio signal; and a plurality of amplification device which the plurality of divided audio signals are input respectively into, and amplifies and outputs the plurality of divided audio signals respectively; and the speaker device of claim 4 is used as the speaker device.

Advantage of the Invention

According to the abovementioned means (1) and (2), it is possible to provide a technique capable of evaluating a performance of audio amplifier and audio device more objectively. Also, according to the abovementioned means (3) through (6), it is possible to provide a technique capable of reproducing sound faithfully from the sound waveform signal of the source wherein the sound waveform includes a sound with complicated harmonics such as the sound of string instruments. Thus, a sound of string instruments and the like can be reproduced extremely natural for the first time.

In order to obtain such effects mentioned above, the inventor of the present invention have proved the following facts.

Thus, it is the fact that the group delay of speaker device and amplifier have in themselves is the biggest obstacle for the sound waveform reproduction of natural sound such as a sound of string instruments or etc. recorded on the source. It had not been clearly recognized that this 'group delay' have a decisive influence on 'waveform reproduction of natural sound' though 'group delay' was known previously. Further, it is a fact that the 'group delay' peculiar to audio device such as amplifier determines a sound quality peculiar to audio device such as amplifier. Thus, it is made clear that 'group delay' is a previously unknown physical factor which controls sound quality. In other words, physical characteristic which is considered to be a problem traditionally other than 'group delay' such as distortion ratio or S/N ratio or etc., have very little to do with a sound quality. The present invention is provided based on these facts clarified by the inventor.

The group delay ($\tau g$) herein is expressed by a formula $\tau g = d\phi/d\omega$ wherein $\phi$ is a phase difference between input waveform and output waveform and $\omega$ is an angular frequency, where a certain frequency signal is input to a certain signal system. To put it simply, a value of a group delay indicates a degree of a delay time difference depending on a frequency. For example, a delay time is stable when a value of a group delay is zero regardless of the frequency and when a value of a group delay is zero or more, a delay time difference is caused depending on a frequency according to the value of the group delay. Thus, when a group delay is large, a delay time become largely different from each other while the difference of the frequency is little. Namely, on the assumption that two frequency different signals input simultaneously, these two signals are output separately with different time delay depending on the value of the group delay.

A value of group delay particularly in a low frequency range of a large-diameter speaker is very large. For example, a group delay characteristic of a speaker having a diameter of approximately 30 cm is focused. In a time period between an application time of electric signal of plural frequency sound to a speaker, and an output time of the sound, 50 Hz tone is known to be reproduced with a delay of several millisecond from the output of 500 Hz tone. This is due to the phenomenon that low frequency takes more time required to vibrate the cone paper after the application of the electric signal.

When an audio signal having a waveform of superimposed 500 Hz wave and 50 Hz wave, is input to a speaker having such a group delay, sound of 50 Hz wave is reproduced with several millisecond delay after a reproduction of sound of 500 Hz wave. In other words, the peak position of 500 Hz wave on the 50 Hz wave shifts for the period of several millisecond.

Here, particularly, a waveform of natural original sound including a sound of string instruments or the like is different from a wave of simple repetitive waveform, as it were non-repetitive or asymmetrical waveform. It is typically a plurality of waves having complicated shape superimposed each other. With a sound having these complicated waveform, a peak position of 500 Hz wave on a specific position of 50 Hz wave (positional relation in time axis) changes when the group delay is found. From this, it follows that the reproduced waveform become different from the original one. As a result, it is apparent that a sound is reproduced differently. Therefore, in principal, it is impossible to reproduce waveform when a group delay is found (i.e. the value of the group delay is not zero in entire frequency range). In contrast, it is possible to reproduce a positional relation between superimposed waves when a group delay is not found (i.e. the value of the group delay is zero in entire frequency range) even with a plurality of superimposed waves having complicated waveform. In addition, it is considered to be possible to reproduce waveform when a frequency characteristic is uniform in entire reproduction frequency range (i.e. when a peak height in entire frequency range is possible to be reproduced).

Based on the above studies, in conclusion, it is found that an objective evaluation of performance of audio device become possible by inputting an audio signal having a waveform in which a plurality of waves with different frequency components are superimposed, into a system to be measured, comparing the sound waveform before input and the sound waveform after output, and finding the degree of conformity therebetween. In contrast, traditional evaluation method is considered to be totally ineffective since the method is based on factors which is not related to an ability of the waveform reproducibility of original sound such as a sound of string instruments or the like.

When components such as L (coil), C (capacitance; capacitor) and R (resistance) are present in an audio signal transmission path including amplifiers, they effect as a kind of filter and work as a delay circuit against the audio signal passing through. And, delay time of the delay circuit have a frequency dependence. In fact, it is apparent that there is a group delay also in an audio signal transmission path though it is much small compare to the one of the speaker. Since a large number of resistance, capacitor or transistor and the like used particularly in the amplifier have components of L, C and R, a group delay caused by the components cannot be ignored.

In amplifiers, there are no documents and etc. clarifying the factor that controls the difference of sound so far. This is because there have been a large difference of sound between two amplifiers having exactly the same distortion ratio, S/N ratio, frequency characteristic, damping factor and other physical factors which have been considered to be problematic. According to the studies of the inventor of the present invention, it is found that the difference of the group delay characteristic mainly controls the difference of sound. Namely, when the components of L, C and R interposed by the amplifier equivalently differ and different filters are interposed, inherent group delay is respectively held as a result and inherent sound is reproduced due to the inherent group delay.

Also, a sound is a time change of air density in space, and audio device is a device for conversing various time change of electric signals conversed from the time change of air density by microphones or etc. The various time change of electric signals is represented by the sound waveform signals. A sound can be considered to be relatively simple determined primarily by this sound waveform. Therefore, the sound is same when the final sound waveform is same regardless of the difference of other factors, and the sound is not same when the final sound waveform is not same regardless of conditions of other factors. However, it is apparent by experience of testing in blind that objective judgement of sound quality is extremely difficult though it is possible to distinguish the difference of sound by hearing. An evaluation of sound is largely influenced by individual difference of hearing or as it were placebo effect since an information required to distinguish the sound is extremely less compare to image evaluation or the like.

From the point of view of image evaluation, huge quantity of information such as information specifying two-dimensional shape, brightness in each point of the two-dimensional shape and further in a case of color, information specifying color on each point, is taken into consideration to determine its quality compare to a sound evaluation. Namely, in the case of image evaluation, an image can be specified and memorized faithfully by anyone without making any mistakes since it can be identified based on the huge information. The image can be immediately judged whether it is correct or wrong by comparing it with the similar correct image memorized in advance. In comparison to this, quantity of information for a sound evaluation is few like a silhouette appears and disappears in a moment. In other words, in the case of a sound evaluation, most people cannot identify and memorize the sound faithfully as an image evaluation due to a terrible lack of information. Also, a sound is evaluated by comparing it with a sound based on a vague memory and it is difficult to identify whether a sound is correct or wrong though it is possible to feel that something may be different. A sound evaluation is extremely vague compare to an image evaluation.

In an image evaluation, when image distortion, color shift or color irregularity are found in reproduced image, it is identified as wrong image immediately and not only the abnormality of the source alone but also the abnormality of the device is suspected. This is, projected source viz. film image is a correct image without any color shift, image distortion or the like in most cases and the correct image reproduced by reproduction device can always be seen.

Therefore, enough information is obtained to identify whether the reproduced image is correct or wrong immediately.

In contrast, in a sound evaluation, depending on a generation of frequency characteristic compared to image distortion or group delay characteristic compared to color shift, the sound cannot be immediately identified as a correct sound generally. Thus, figuratively speaking, the abnormality can be noticed immediately in the case of image evaluation when the recorded color film image is projected like a Picasso. However, it is nearly impossible to notice the abnormality of the sound in the case of sound evaluation. This is, in sound, every sound reproduced from current audio device is incorrect viz. multifarious sound having image distortion, color shift or etc. in a figurative sense. No clues had yet been found to distinguish whether the sound from the reproduction device is correct or not since no one ever had an experience to hear a correct sound reproduced from the reproduction device.

Therefore, current circumstance of traditional evaluation for audio device seem to be like an evaluation of a quality of projected Picasso in a figurative expression such as admiring exquisite beauty of color shift pattern or artistic quality of degree of image distortion. It is no exaggeration to say that this is not a 'reproduction device' and as it were a device replacing source for music box, attaching various units viz. source to various boxes viz. audio device one after another to competitively enjoy a kind of beauty of the sound of music box.

Anyone can clearly realize that these abovementioned figures are not always incorrect by comparing the audio device according to the present invention and traditional general audio device. More specifically, the present invention is provided to achieve 'reproduction of natural sound waveform' by focusing on an attribute of natural sound waveform. And, it is approached close to the 'reproduction of natural sound waveform' by extracting various possible failure factor for original sound waveform reproduction and eliminating the failure factor one by one. It is, so to speak, the present invention approached very close to reproduce the correct sound. As a result, reproduction of natural sound which is thought to have many harmonic components represented by a sound of string instruments changed from plate uncoated sound or electroacoustic sound to acoustic musical instruments-like sound which can be listened very vivid and naturally. Moreover, it is thought to be applied not only to specially selected source but also many other sources recorded normally.

In traditional audio device, there are very few audio devices capable of reproducing sound closer to the correct sound, but existed when specially selected and limited source is reproduced. However, in such device, when a source other than the very limited source is reproduced, its sound might be just a noise or sound hard to hear and naturalness is not able to be felt in not a few cases. Traditionally, such source is considered to have a poor recording. And a good-quality recording source is considered to be very limited. According to the audio device of the present invention, it is possible to provide a reproduced sound which can be felt naturally without a noise in such many sources and sufficient feeling that the sound is recorded correctly.

There is an erroneous idea that processing sound of source by audio device is a way for approaching closer to original sound on the assumption that original sound reproduction by audio device is impossible in the first place since recorded sound on source is already different from original sound, and if so, faithful reproduction is unreasonable in the first place. Whereas it is apparent that abovementioned idea is wrong as mentioned above, another reason is as follows. First of all, no examples with concrete means based on such idea is shown as an implementing mean even the idea is presented. As a reason for this, it is not possible to present it even if it is desired to since there are no way for objectively specifying or presuming the original sound which is a basis of the sound recorded on source with the exception of the sound recorded on source. Subjective presumptions may be a random guess. It is considered to be next to impossible to presume the natural sound waveform of musical instruments or the like by simple complementing method since its waveform is very complicated.

To begin with, audio device should be considered to be a device of reproducing sound recorded on source faithfully, not a device of reproducing 'original sound'. This is seem to be a matter of course when image reproduction device such as projector projecting image recorded on the film or etc. faithfully is taken into consideration. No one would conceive an idea to try to process an image recorded on film and reproduce 'filming location' which corresponds to 'original sound'. In this case, faithful reproduction of sound on source means faithful reproduction of sound waveform. In the traditional audio world, it is seemed to be devoted to pointless concept of 'original sound' reproduction without any objective point of view and focused entirely on unsuitable modification of hardware or abstract linguistic game which have nothing to do with the waveform reproduction.

It is logically impossible to savor the original sound unless it is performed live. However, the closest sound to the original sound or the most effective sound reminiscent of the original sound is considered to be a sound which is reproduced faithfully as recorded on the source wherein a part of information of the original sound is cut off and recorded on the source. Figuratively speaking in an image display, it is appeared to be similar to the fact that thoroughly excluding the image distortion or color shift or the like for the faithful reproduction of the image of film on the screen, is the only way to reminisce the filming location naturally. When the deformation corresponds to distortion of the image or color shift or the like is found, it can be objectively understood that the sound is going far from naturalness even if the approach to the original sound is insisted subjectively.

Therefore, current audio device is equal to an emission of the sound against the source having deformation corresponds to distortion of the image or color shift or the like which should not be overlooked by whomever viewed in image evaluation. Such situation is seem to be neglected in a current audio world. In this regard, there was nothing for 'waveform reproduction of natural sound' including 'complicated waveform' by the performance of audio equipment wherein the speaker is mainly applied until recently.

However, according to the study of the inventor of the present invention, 'waveform reproduction of natural sound' is found to become possible by applying newly developed technology. That is, a sound field correction technology using digital filters applied to AV amplifiers or etc. This sound field correction technology includes frequency correction, room correction viz. distortion correction of reflection sound of the room and group delay correction. However, there are a few precedent where this sound field correction technology was applied to as it were pure audio since this technology is strongly recognized as performing tool for adjusting sound pressure balance, phase, reproduction frequency or etc. between each speaker of 5.1 channel surround system mainly. Also, in the case of applying it to the pure audio, it is ambiguously recognized as a correcting tool for adjusting the sound field of the room. It is not apparently recognized as a decisive indispensable tool for 'waveform reproduction of natural sound' yet.

The inventor of the present invention have found that the sound field correction technology is indispensably required for performing 'waveform reproduction of natural sound' including 'complicated waveform' viz. non-repetitive or asymmetrical waveform which is considered to be impossible to be reproduced by traditional speakers or amplifiers and reached the present invention. In other words, 'waveform reproduction of natural sound' including 'complicated waveform' which is considered to be impossible to be reproduced traditionally, can be only accomplished by using the sound field correction technology.

More specifically for example, to perform 'waveform reproduction of natural sound' including 'complicated waveform' which is non-repetitive or asymmetrical in which a plurality waves with different frequency are complicatedly superimposed such as waveforms of string instruments, wind instruments, percussion instruments, other instruments or the like. It is required to reproduce not only positional relation among superimposed waves viz. peak position relation but also the wave height. A reproduction of positional relation among superimposed waves viz. peak position relation or phase relation is realized by making ideal group delay characteristic viz. making the value of the group delay zero in entire frequency. A reproduction of wave height is realized by making frequency characteristic equal. As mentioned above, waveform reproduction cannot be realized without prescribed value of 'group delay' viz. expressing the value of the group delay in each frequency and 'frequency characteristic' viz. expressing the sound pressure level in each frequency, in speakers or amplifiers. However, 'waveform reproduction of natural sound' including 'complicated waveform' is performed by using the sound field correction technology to correct these characteristic.

In this case, group delay of the speaker is not always completely corrected by the correction of sound field correction device in large-diameter speakers since the larger the diameter is, the larger the group delay of the speaker is. On the other hand, small-diameter speakers have small group delay, however, required sound pressure level is not ensured in low frequency range and group delay is not always completely corrected by the sound field correction device. To obtain excellent group delay and flat frequency characteristic, numerous small-diameter speakers are used so as to ensure a certain level of the sound pressure level of low frequency range in a small group delay manner while an excessive sound pressure due to an excessive use of speakers in a intermediate and high tone is cut by using an amplifier having a sound field correction device.

According to the study of the inventor, correction result in the sound field correction is output only to the cone paper which is the vibrator of the speaker. Therefore, when noise caused by vibration other than that of the cone paper is included in the measuring value which is the basis of the correction, it is not properly corrected since the correction is performed against the noise included value. From this point of view, in the current speakers, there might be full of noise that cannot be ignored other than a sound emitted from the surface of the cone paper such as sound which is emitted from the back of the cone paper, reflected in the box and emitted through the box or sound made by vibration of the surface of the box or the like.

In fact, when the sound source such as strings or voices is reproduced from 'traditional type' speaker and the reproduced waveform is compared with the original waveform of the speaker, no big difference is seen in the waveform reproducibility whether the sound field correction is performed or not. Both waveforms are significantly different from the original waveform. As a result of investigating a way for removing the noise mentioned above as much as possible, the inventor of the present invention have found that leaving the box which emit sound by the vibration alone might be the problem. Then, according to the speaker of the present invention, a part relevant to the box is covered with sound-absorbent member or vibration control member as much as possible or a part relevant to the box alone is taken off and a part other than a surface of the cone paper is covered with sound-absorbent member or etc., as much as possible. As a result, according to the speaker device of the present invention, there is a significant difference in the waveform reproducibility between the waveform with the sound field correction and the one without it. With the sound field correction, the waveform of the sound emitted from the speaker approached very close to the original waveform recorded on the source. In other words, it is found that the correction is performed extremely efficiently. This is the reason why the reproduced sound from the device of the present invention is very natural as never experienced before in traditional devices.

In the multi-way type speakers, the speaker device for low frequency range with numerous small-diameter speakers and another speaker for intermediate and high frequency range are consisted. These speakers are driven by multi-amplifier with channel divider so as to ensure sufficient sound pressure level and less group delay in low frequency range. Moreover, it is possible to balance the sound pressure in entire frequency range without any disturbance of frequency characteristic in intermediate and high frequency range. Furthermore, with such audio device, it is possible to provide an extremely effective correction by correcting group delay and frequency characteristic using the sound field correction device. By performing this correction, 'waveform reproduction of natural sound' including 'complicated waveform' can be performed more faithfully.

Group delay correction and frequency correction by the sound field correction device is performed by using digital filter such as known FIR filter or the like. With this structure, it is possible to perform correction relatively easily without causing any phase disturbance. As used generally in known AV amplifiers, these corrections are performed by reproducing signal to be measured for measuring group delay or frequency characteristic from the audio device, analyzing the sound detected by microphone, preparing an acoustic transfer function which performs a reverse correction from obtained group delay characteristic or frequency characteristic and correcting based on the acoustic transfer function. Preferable filter tap coefficient is at least thousand or more, or about hundreds of thousands if possible since the correction device using FIR filter is able to correct more faithfully with more filter tap coefficient. Additionally, frequency processing is preferably at more than 192 kHz and 24 bit.

EXAMPLE 1

Evaluation Method for Audio Device

Figure 1:
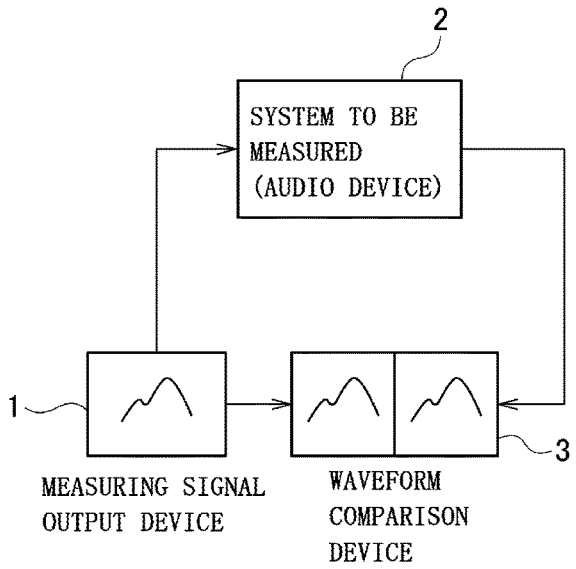
FIG. 1 is a view showing the evaluation method of the audio device according to example 1 of the present invention.

FIG. 1 is a view showing the evaluation method for the audio device according to an embodiment of the present invention. As shown in FIG. 1, in the evaluation method for the audio device according to the present invention, a signal to be measured output from a measuring signal output device 1 is input to a system to be measured 2 in which an evaluation target audio device is installed in, and output signal from the system to be measured 2 is input to a waveform comparison device 3. The signal to be measured before the input to the system to be measured 2 is input to the waveform comparison device 3 simultaneously. Then, the waveform before the input to the system to be measured 2 and the waveform output from the system to be measured 2 are compared by the waveform comparison device 3 and a degree of conformity therebetween is evaluated to evaluate a performance of the audio device installed in the system to be measured 2.

Figure 2:
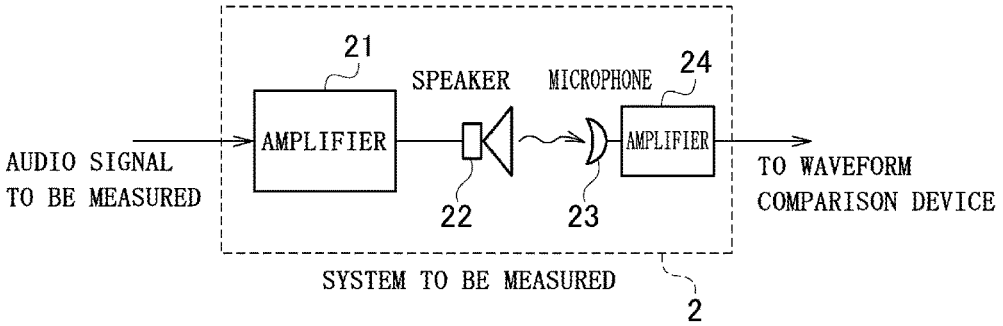
FIG. 2 is a view showing a specific example of system to be measured 2.
Figure 3:
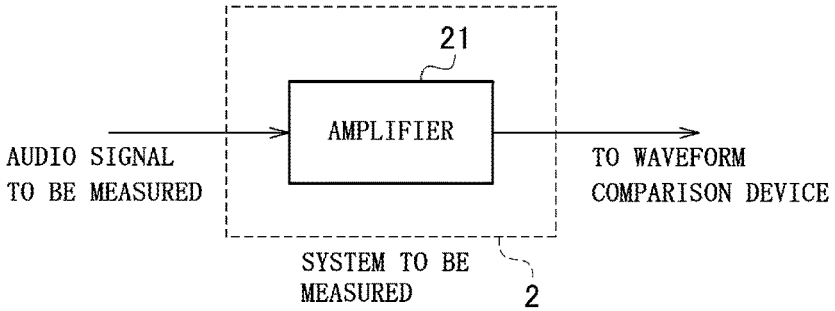
FIG. 3 is a view showing a specific example of system to be measured 2.

FIG. 2 and FIG. 3 are views showing a specific example of system to be measured 2 and in the example shown in FIG. 2, the audio amplifier 21 and the speaker 22 are installed in as the evaluation target audio device. The measuring signal sound from the speaker 22 is detected by microphone 23 and amplified signal by the amplifier 24 is output to the waveform comparison device 3. Also, in the example shown in FIG. 3, the audio amplifier 21 is installed in singly as the evaluation target audio device; the amplifier 21 is installed in the system to be measured 2 only, and output by the amplifier 2 is delivered to the waveform comparison device 3 as it is.

The measuring signal output device 1 is a device which delivers the signal to be measured. The signal to be measured herein is an audio signal including asymmetrical or non-repetitive 'complicated waveform' in which a plurality waves with different frequency are complicatedly superimposed like a waveform alone of 'natural sound' of other instruments such as string instruments, wind instruments, percussion instruments and the like, or a waveform of those 'natural sound', for example.

Figure 4:
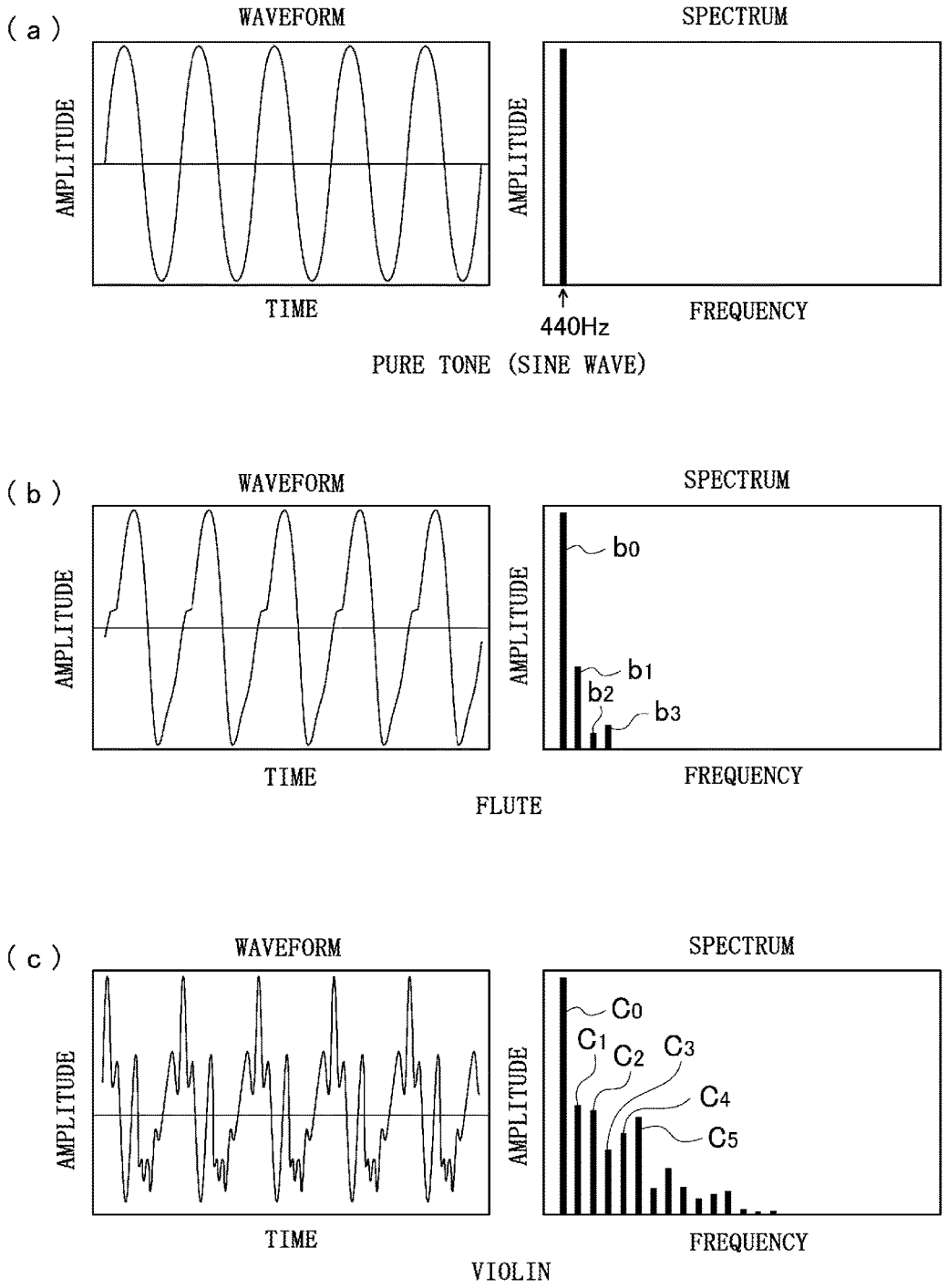
FIG. 4*a* is a view showing waveform and spectrum of pure tone (sound of tuning fork; simple sine wave) at 440 Hz.
FIG. 4*b* is a view showing waveform and spectrum of sound of flute at fundamental sound of 440 Hz.
FIG. 4*c* is a view showing waveform and spectrum of sound of violin at fundamental sound of 440 Hz.

FIG. 4 is a view showing a waveform and frequency component (spectrum) of sound, FIG. 4*a* is a view showing a waveform and frequency of pure tone (sound of tuning fork; simple sine wave) at 440 Hz. Also, FIG. 4*b* is a view showing waveform and spectrum of sound of flute at fundamental sound of 440 Hz and FIG. 4*c* is a view showing waveform and spectrum of sound of violin at fundamental sound of 440 Hz. In FIG. 4*a* through FIG. 4*c*, a view showing a waveform (left figure) represents amplitude on the vertical axis and time on the horizontal axis, and a view showing a spectrum (right figure) represents amplitude on the vertical axis and frequency on the horizontal axis. The time axis in a view of waveform is widened so that the waveform can be easily seen. The sound having the waveform shown in FIG. 4*b*, or the sound with the waveform shown in FIG. 4*c* is used for the signal to be measured.

With such an audio signal including asymmetrical or non-repetitive 'complicated waveform' in which a plurality waves with different frequency are complicatedly superimposed is input into the audio device, deformation of an output waveform occurs depending on its unique group delay characteristic. In other words, generation of the group delay indicates that the delay time varies when the frequency varies. Then, for example, it is apparent that no deformation of waveform occurs in signal with a waveform of single wavelength as shown in FIG. 4*a*. However, it is considered that a movement of peak position of harmonic wave b1 through c1 and c1 through c5 for peak position of fundamental wave b0 and c0, results in deformation of waveform with signals of waveform as shown in FIGS. 4*b* and 4*c*.

Therefore, such signal to be measured is input into target audio device, the degree of conformity is confirmed by comparing the sound waveform before the input and the sound waveform after the input, and it can be said that the fewer the degree of conformity is, more faithfully the waveform reproduced. In other words, a performance of the audio device can be possibly evaluated based on the quality of the degree of conformity between the waveform before the input and the waveform after the output. The measuring signal output device 1 can be composed of a device reproducing and outputting the signal to be measured recorded on the recording medium mentioned above, for example, or a computer device with a software in which the program is generated to prepare and output signal to be measured. The signal to be measured can be obtained by recording sound of instruments such as string instruments, wind instruments, percussion instruments and etc., or synthesizing plurality of frequency audio signal.

The wave comparison device 3 is a device confirming a degree of conformity of waveforms wherein the audio signal before the input into the audio device and the audio signal after the output from the audio device are both input and their waveforms are compared. Such wave comparison device 3 can be composed of hardware consisting known electric circuit such as waveform storage circuit, comparator or the like. Also, for example, it can be composed of a computer device with software in which the program is generated to evaluate the degree of conformity of waveform by comparing waveforms of two input signals and calculating the amount of the peak position fluctuation of harmonic component contained in the waveform. For example, waveform comparison is carried out by widening the time axis if necessary and focusing on the characteristic peak of specific frequency of the waveform while making the time axis coincident.

According to the evaluation device for audio device described above, the degree of conformity of the waveforms can be calculated quantitatively and objectively by calculating the peak position fluctuation of harmonic component, for example. It is achieved to evaluate audio device objectively by determining the degree of conformity for the first time. When the amplifier 21 is replaced with audio device such as audio cable in the system to be measured 2, for example, objective evaluation for the audio cable become possible. Namely, when the waveform before the input is completely equivalent to the waveform after the output, it is possible to determine that no sound changes by the audio device occurred. Quality of the audio device fidelity can also be determined objectively by the size of deformation degree of the waveform in case where the deformation of the waveform is found.

EXAMPLE 2

Audio Device

Figure 5:
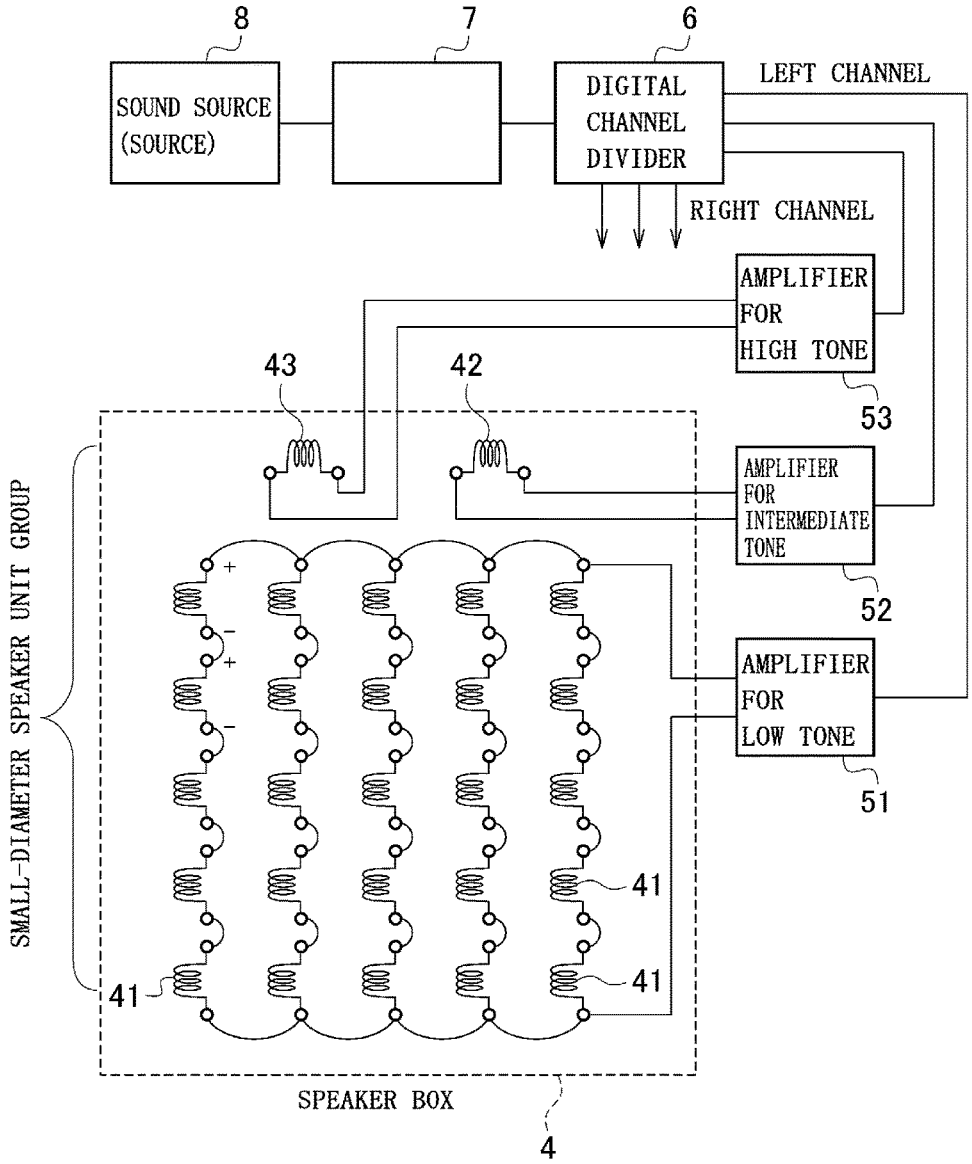
FIG. 5 is a block diagram showing the audio device according to example 2 of the present invention.
Figure 6:
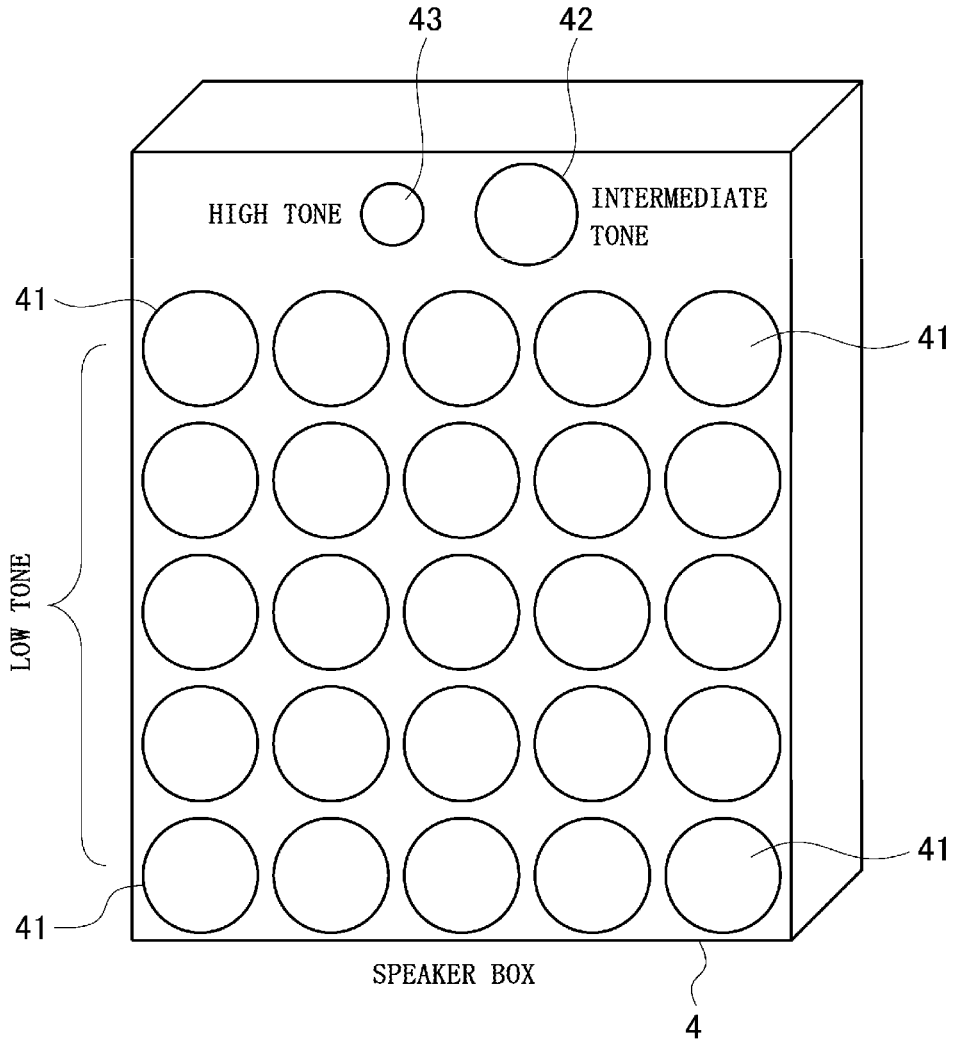
FIG. 6 is an outside appearance view of the speaker box 4.
Figure 7:
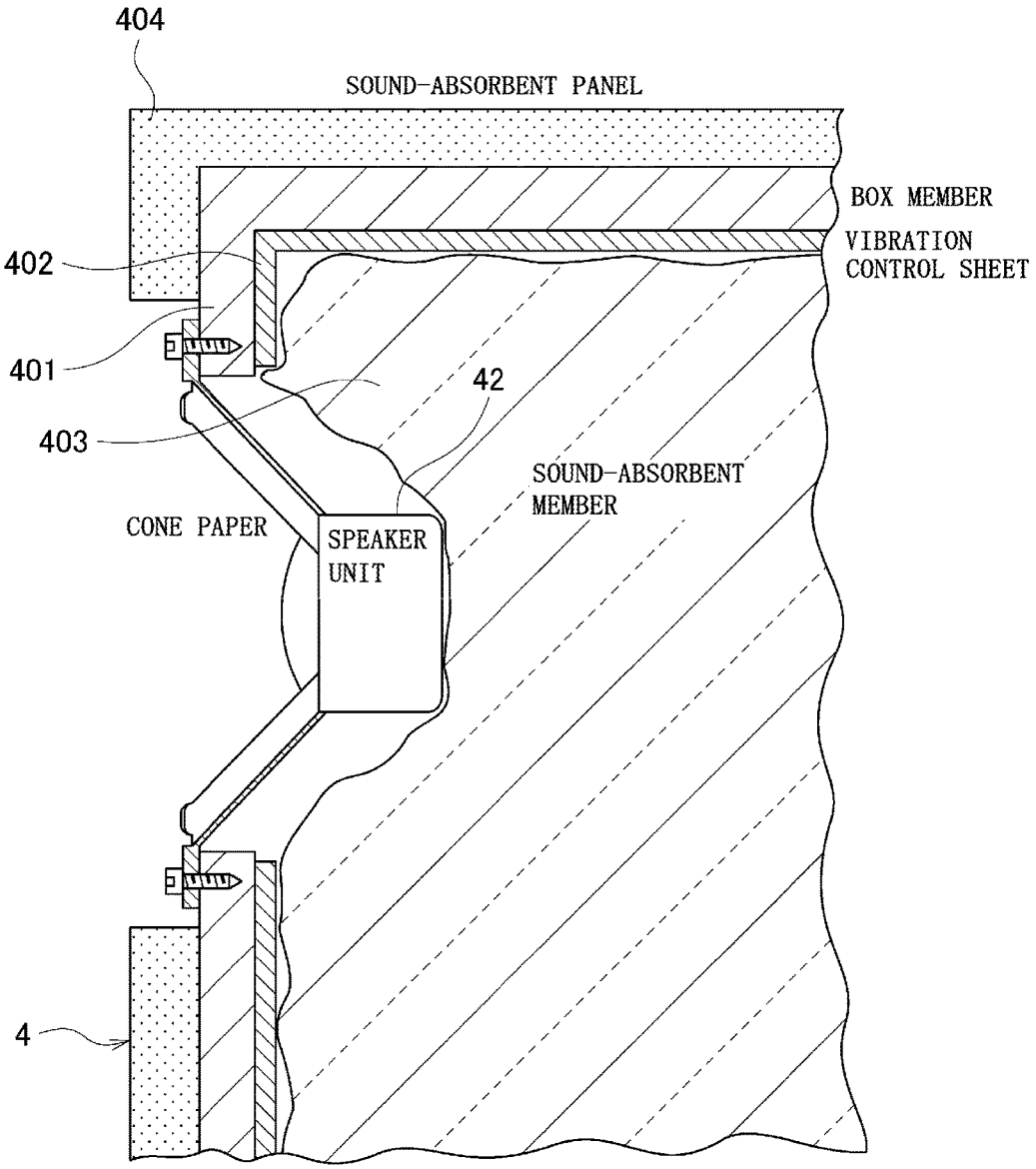
FIG. 7 is a partially sectional view of the speaker box 4.

FIG. 5 is a block diagram showing the audio device according to example 2 of the present invention, FIG. 6 is an outside appearance view of the speaker box 4 and FIG. 7 is a partially sectional view of the speaker box 4. As shown in these figures, the audio device according to an embodiment is configured of a speaker box 4, an amplifier for low tone 51 driving the speaker in the speaker box 4, an amplifier for intermediate tone 52, an amplifier for high tone 53, a channel divider 6 outputting low tone signal and intermediate tone signal to these amplifiers, a preamplifier with sound field correction function 7 outputting audio signals to this channel divider 6 and a sound source device 8 outputting signals to the preamplifier 7.

The speaker box 4 is configured of 25 speakers for low tone 41, 1 speaker for intermediate tone 42 and 1 speaker for high tone 43. The speaker for low tone 41 and the speaker for intermediate tone 42 are small-diameter speakers in a diameter of around 2 inches, for example. Also, the speaker for high tone 43 is a small-diameter speaker in a diameter of around 1 inch. The speaker for low tone 41 herein works as a speaker for low tone with 25 speakers by arranging 5 voice coils connected in series in a pairs and connecting these serially connected 5 pairs in parallel. These 27 speaker groups are attached to the speaker box 4 as shown in FIG. 6 and FIG. 7. It is preferable to apply speakers with a possible small diameter for the speaker for low tone 41 as many as possible, however, its diameter can be around 1 inch through 5 inches when a commercial speaker is applied. In that case, it is apparent that the smaller the diameter, the more the number of speakers used.

As shown in FIG. 7, the speaker box 4 is consisted of a box body 401 formed in a rectangular parallelepiped shape case, a vibration control sheet 402 located in inner surface of this box body 401, a sound-absorbent member 403 filled inside the box body 401 and a sound-absorbent panel 404 located so as to cover an external surface of the box body 401. The box body 401 is made of materials less liable to generate vibration such as metal aluminum plate, tough wood or etc. The vibration control sheet 402 is made of lead plate or other vibration control member. The sound-absorbent member 403 is made of cotton having high sound absorbing performance, rock wool, or etc. The sound-absorbent panel 404 is made of sound absorption panel of panel shaped sound absorbing urethane, rock wool, or etc.

The amplifier for low tone 51, the amplifier for intermediate tone 52 and the amplifier for high tone 53 are individually the power amplification amplifier for driving the speaker for low tone 41, the speaker for intermediate tone 42 and the speaker for high tone 43 with power amplifying the audio signal from the channel divider 6. Since digital amplifiers have low risk of generating a group delay in the amplifier, full digital amplifier is preferably used for these amplifiers. Also, a path for audio signal passing through is preferably subjected to digital processing of less group delay as much as possible. In that case, sampling frequency and digital processing format are preferable to be as large as possible of 192 kHz and 24 bit etc., for example.

The channel divider 6 is a divider which sends an audio signal from a preamplifier 7 to the amplifier for low tone 51, the amplifier for intermediate tone 52 and the amplifier for high tone 53 wherein the audio signal is divided into frequency-domain audio signal of low tone, intermediate tone and high tone respectively. The channel divider 6 is configured of many digital filters such as FIR filter or IIR filter, etc. Using analog channel divider wherein capacitor or resistance is used is not preferable since this channel divider is the cause for harmful group delay against the waveform reproduction. The channel divider with a large number of digital filters such as FIR filters or IIR filters can be configured of computer device wherein a large number of digital filters such as FIR filters or IIR filters are programmed to perform as a channel divider. It is preferable to use FIR filters excellent in phase characteristic if possible. Filter tap coefficient is thousand or more, or about hundreds of thousands if possible.

The preamplifier with sound field correction function 7 is configured of an amplifier which amplifies the audio signal from the sound source 8 by the amplifier and a computer device which performs the sound field correction processing. Sound field correction herein includes all the group delay correction, frequency correction and characteristic of room correction viz. mainly distortion correction of reflection sound and etc. of the room. The group delay correction, frequency correction and characteristic of room correction are performed by using digital filters such as known FIR filters etc. With this structure, correction can be performed comparatively easily without causing any phase turbulence. Herein also, the filter tap coefficient is thousand or more, or about hundreds of thousands if possible.

These correction, as used generally in known AV amplifiers, is performed by reproducing the signal to be measured for measuring its group delay characteristic, frequency characteristic and characteristic of room by audio device, detecting it by microphone, analyzing, preparing an acoustic transfer function for a reverse correction from obtained group delay characteristic and frequency characteristic, etc., performing processing by the acoustic transfer function, building a computer device which is programmed to perform those processing into the preamplifier 7. The sound device 8 is a sound sending device wherein an audio signal is read from a recording medium in which a digital or analog signal of known CD player or record player or etc. is recorded, the audio signal is converted into predetermined signal and sent to preamplifier 7.

According to an embodiment of the abovementioned evaluation method for audio device, it is possible to provide a technique capable of evaluating a performance of audio amplifier and audio device more objectively. Also, according to an embodiment of the abovementioned audio device, it is possible to provide a technique capable of reproducing sound faithfully from the sound waveform signal of the source wherein the sound waveform includes a sound with complicated harmonics such as the sound of string instruments is recorded and reproducing a sound suck as a sound of string instruments or etc. extremely similar to real sound for the first time. That is, the sound waveform recorded on the source is reproduced faithfully at least through the surface of the speaker into the sound by correcting the group delay characteristic and frequency characteristic. Then, a deformation of the sound waveform from the speaker is prevented by performing correction of characteristic of room while suppressing sound other than the sound from the surface of speaker to the utmost. It is possible to listen to the sound reproduced faithfully from the sound waveform recorded on the source. Anyone can recognize just in a moment what the original real sound is and how the sound is deformed in traditional audio device by comparing the difference between the sound of various traditional audio device and the sound according to an embodiment of the audio device.

Further, in an embodiment of the audio device, it is found that speaker box can be formed very small compare to the traditional by using numerous small-diameter speakers for speaker device in charge of low tone. Since large space is required on back side of cone paper to reproduce low tone by vibrating whole 1 cone paper with large area, reproduction of low tone by large-diameter speaker required large box.

However, in the present invention, only a little back surface space is required for 1 small-diameter speaker and the space in total is small enough to satisfy the space required compared to traditional ones. Therefore, despite the speaker is very small, reproduction of satisfactory low tone sound become possible. Also, a reproduction of powerful and natural low tone sound is achieved since group delay generated in the low frequency range is extremely small and response of vibration is extremely quick. Further, it is manufactured at very low cost. Using numerous inexpensive small-diameter speakers can reduce the cost much more than using 1 large-diameter speaker. Also, the size of the speaker box can be extremely small. Moreover, since there is no need to use special expensive materials, it can be sufficiently and inexpensively configured compared to the traditional device.

EXAMPLE 3

Audio Device

Figure 8:
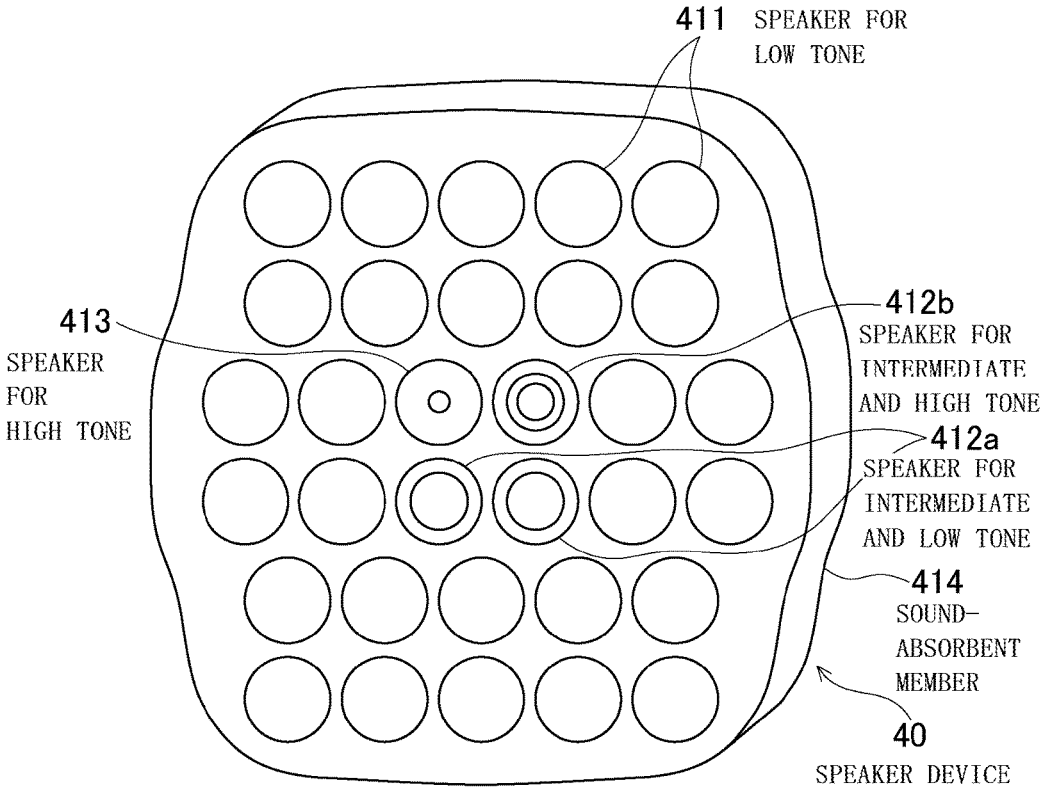
FIG. 8 is an outside appearance view of the speaker device 40 in the audio device according to example 3 of the present invention.
Figure 9:
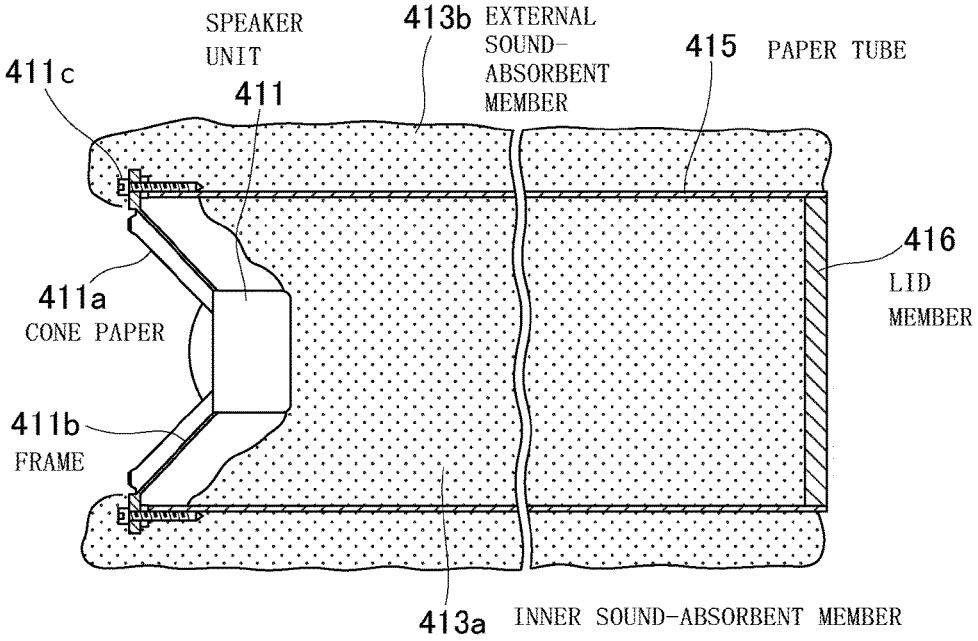
FIG. 9 is a view showing the components of the speaker for low tone 40.
Figure 10:
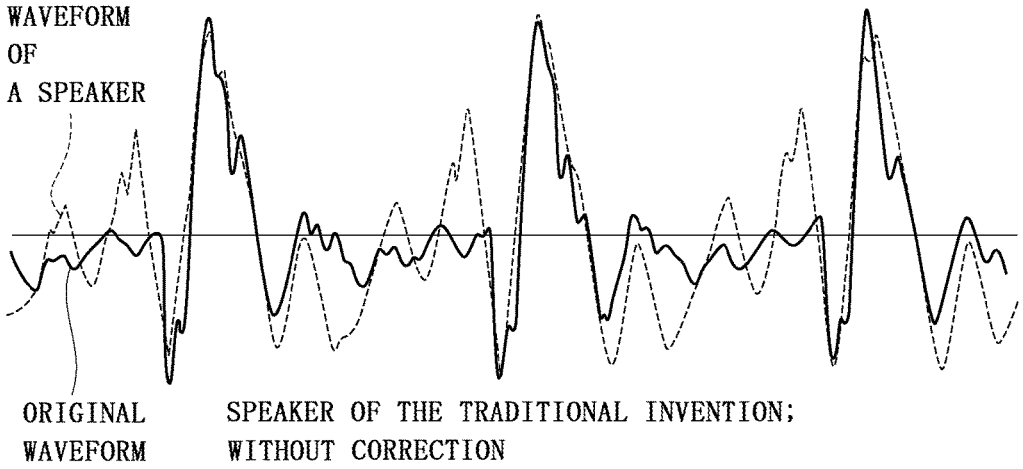
FIG. 10 is a waveform comparison chart obtained by a traditional speaker device with no sound field correction wherein the sound waveform recorded on the source is shown over the sound waveform of reproduced sound of the audio signal of the source where the sound is detected by a microphone from the audio device according to example 3.
Figure 11:
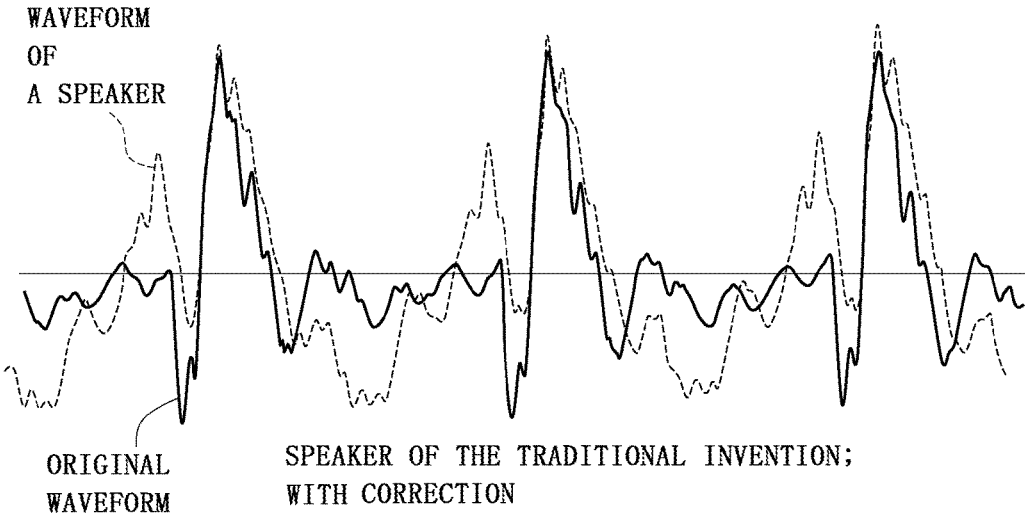
FIG. 11 is a waveform comparison chart obtained by a traditional speaker device with sound field correction wherein the sound waveform recorded on the source is shown over the sound waveform of reproduced sound of the audio signal of the source where the sound is detected by a microphone from the audio device according to example 3.
Figure 12:
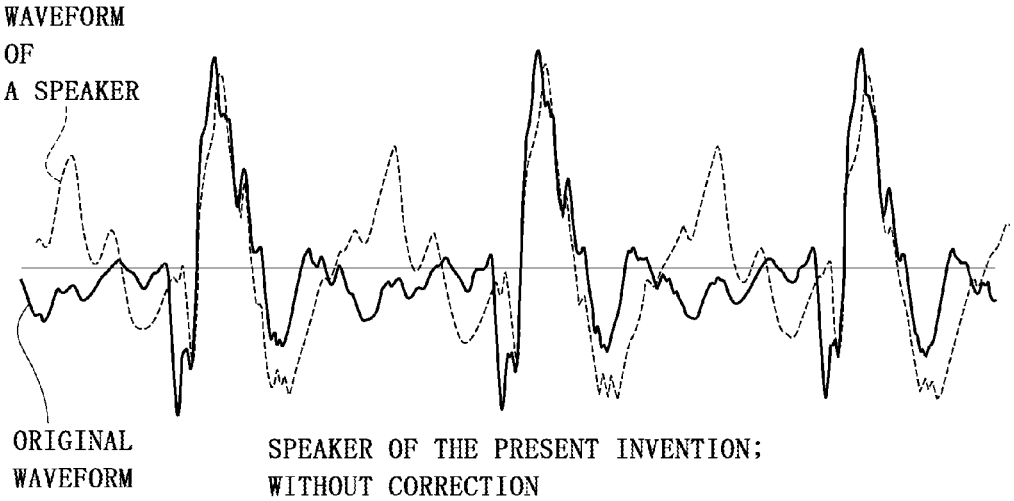
FIG. 12 is a waveform comparison chart obtained by the speaker device according to example 3 with no sound field correction wherein the sound waveform recorded on the source is shown over the sound waveform of reproduced sound of the audio signal of the source where the sound is detected by a microphone from the audio device according to example 3.
Figure 13:
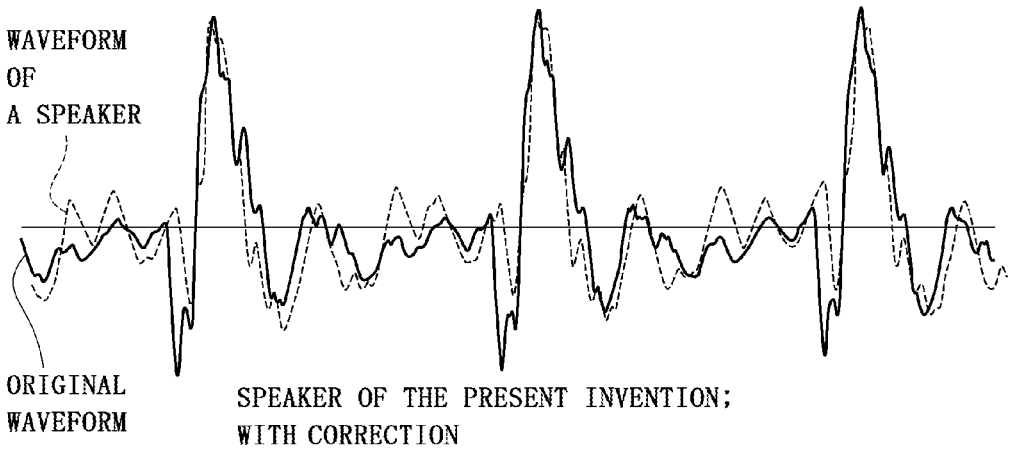
FIG. 13 is a waveform comparison chart obtained by the speaker device according to example 3 with sound field correction wherein the sound waveform recorded on the source is shown over the sound waveform of reproduced sound of the audio signal of the source where the sound is detected by a microphone from the audio device according to example 3.

FIG. 8 is an outside appearance view of the speaker device 40 in the audio device according to example 3 of the present invention and FIG. 9 is a view showing the components of the speaker for low tone 411. The audio device of the example 2 mentioned above has multiple amplifier with 3 channels, however, the audio device of an example 3 differs on points that the audio device of an example 3 has multiple amplifier with 4 channels and amplifiers used in are for 4 channels, and the speaker device 40 used in is also for multiple-way 4 channels. However, since the channel divider and amplifier have the same configuration as the example 2, these specifications are abbreviated and the speaker device 40 will be described hereafter.

The speaker device 40 is configured of 28 speakers for low tone 411, 2 speakers for intermediate and low tone 412*a*, 1 speaker for intermediate and high tone 412*b* and 1 speaker for high tone 413 fixed in an arrangement relation as shown in FIG. 8. In the speaker for low tone 411 and the speaker for intermediate and low tone 412*a*, speaker with a diameter of 10 cm so-called full-range speaker is used. Also, speaker with a diameter of 7 cm is used for the speaker for intermediate and high tone 412*b*. Further, an exclusive speaker for high tone so-called Tweeter is used for the speaker for high tone 413. A resistance value of the voice coil of 28 speakers for low tone 411 is 8Ω respectively and the resistance value of one set of 4 speakers connected in series is 32Ω. By connecting these 7 sets in parallel, the resistance value becomes equivalent with 1 speaker resistance value at about 4.6Ω from the side of the amplifier. Also, the resistance value of 2 speakers for intermediate and low tone 412*a* becomes equivalent with 1 speaker resistance value at about 4Ω from the side of the amplifier by connecting these in parallel.

In this example, frequency range to 750 Hz is reproduced by 28 speakers for low tone 411, frequency range 750 Hz through 2000 Hz is reproduced by 2 speakers for intermediate and low tone 412*a*, frequency range 2000 Hz through 5000 Hz is reproduced by 1 speaker for intermediate and high tone 412*b* and frequency range 5000 Hz or higher is reproduced by 1 speaker for high tone 413. This crossover frequency can be appropriately determined depending on a performance of the speaker used.

As shown in FIG. 9, the speaker for low tone 411 is a speaker wherein a long screw 411*c* is fixed to a screw hole provided to frame 411*b* of the speaker unit for low tone 4110, a paper tube 415 having a contact diameter of the outer peripheral surface is put into inside of the screw 411*c* and fixed with adhesive tape or etc., an inner sound-absorbent member 413 is filled in the paper tube 415 covered with sound absorbing lid member 416 and the outer peripheral surface of the paper tube 415 and the frame part of the speaker unit 4110 are enwrapped with an external sound-absorbent member 413*b*. An outer peripheral part of the external sound-absorbent member 413*b* is enwrapped with a vinyl tape or etc. as necessary. A tube length of the paper tube 415 requires enough length to absorb injection sound from the back surface of the cone paper 411*a* by the inner sound-absorbent member 413*b*. The tube length is set to 30 cm in this example.

Since the speaker for intermediate and low tone 412*a*, the speaker for intermediate and high tone 412*b* and the speaker for high tone 413 have same structure as mentioned above, an explanation of these is abbreviated. The speaker device 40 is configured of these 28 speakers for low tone 411, 2 speakers for intermediate and low tone 412*a*, 1 speaker for intermediate and high tone 412*b* and 1 speaker for high tone 413 which are arranged in an arrangement relation as shown in FIG. 8, fixed to each other by adhesive tape or etc., enwrapped its outer periphery with sound-absorbent member and maintained a fastened shape by wound around with a packing tape or etc. to prepare the speaker device 40. With this structure, in the speaker device 40, injection sound other than those from the surface of the cone paper of the speaker unit is sufficiently attenuated by the sound-absorbent member. Also, by totally covering parts which is directly contacted to the speaker unit with sound-absorbent member, sound caused by its vibration is sufficiently attenuated. Therefore, an injection sound from this speaker device 40 includes scarcely noise, but mostly signal sound only when the noise is an injection sound from the surface of the cone paper and the signal sound is a direct or indirect injection sound other than those from the surface of the cone paper.

FIG. 10 through FIG. 13 are waveform comparison charts wherein the sound waveform recorded on the sound source is shown over the sound waveform of reproduced sound of the audio signal of the source where the sound is detected by a microphone from the audio device according to the examples. In figures, solid lines show the waveform recorded on the sound source and dotted lines show the waveform detected by the microphone. In these figures, waveform reproducibility becomes excellent when the waveform of the dotted lines are closer to the waveform of solid lines. In the waveform used, a part of a female vocal sound is recorded on a waveform editing software and a time axis is widened, matched and shown over. No sound field correction is performed in traditional speaker in FIG. 10, sound field correction is performed in traditional speaker in FIG. 11, no sound field correction is performed in the speaker of example 3 in FIG. 12 and sound field correction is performed in the speaker of example 3 in FIG. 13. In an abovementioned wave comparison, same devices are used other than the sound field correction device and the channel divider. Therefore, the difference between the two is the speaker device only.

From the result indicated in FIG. 10 through FIG. 13, it is apparent that in traditional devices, the waveform of the speaker differed significantly from the waveform of the sound source not only without the sound field correction but also with the sound field correction. In contrast, in the speaker device of example 3, the waveform of the speaker differed significantly from the waveform of the sound source without the sound field correction whereas the waveform of the speaker is obviously very close to be coincide with or approach the waveform of the sound source with the sound field correction. Therefore, from the point of view of the waveform reproducibility, the sound field correction is not effective for the traditional device whereas it is very effective for the speaker device of example 3.

DESCRIPTION OF SINGS AND NUMERALS

1 measuring signal output device
2 system to be measured
3 waveform comparison device
4 speaker box
40 speaker device
41,411 speaker for low tone
411*a* cone paper
411*b* frame
411*c* attaching screw
42 speaker for intermediate tone
412*b* speaker for intermediate and high tone
43,413 speaker for high tone
401 box member
402 vibration control sheet
403 sound-absorbent member
413*a* inner sound-absorbent member
413*b* external sound-absorbent member
404 sound-absorbent panel
415 paper tube
51 amplifier for low tone
52 amplifier for intermediate tone
53 amplifier for high tone
6 digital channel divider
7 preamplifier with sound field correction function
8 sound source

What is claimed is:

1. A method for evaluating an audio device, comprising:

inputting into the audio device an audio signal having a waveform of recorded sound, the recorded sound being one of string instruments, wind instruments, percussion instruments, or vocal sound;

recording, by a waveform comparison device, a waveform output by the audio device in response to the waveform of recorded sound input to the audio device;

superimposing the recorded waveform on the waveform of recorded sound input to the audio device; and evaluating a performance of the audio device quantitatively by determining a deformation degree of the waveform of recorded sound based on the superimposed waveforms by calculating a peak position fluctuation of harmonic components contained in the waveforms.

2. A device for evaluating an audio device, comprising:

a measuring audio signal output device that outputs, to the audio device that is an evaluation target, an audio signal to be measured having a waveform of recorded sound, the recorded sound being one of string instruments, wind instruments, percussion instruments, or vocal sound; and a waveform comparison device that:

records a waveform of a signal output from the audio device when the audio signal to be measured is output from the measuring audio signal output device and is input to the audio device, superimposes the recorded waveform on the waveform of recorded sound of the audio signal to be measured that is output by the audio signal output device, and determines a quantitative deformation degree of the waveform of recorded sound based on the superimposed waveforms by calculating a peak position fluctuation of harmonic components contained in the waveforms.

* * * * *